US011527855B2

(12) United States Patent
Jung et al.

(10) Patent No.: US 11,527,855 B2
(45) Date of Patent: Dec. 13, 2022

(54) INTEGRATED MULTIPOLE CONNECTOR

(71) Applicants: HYUNDAI MOTOR COMPANY, Seoul (KR); KIA MOTORS CORPORATION, Seoul (KR); KYUNGSHIN CORP., Incheon (KR)

(72) Inventors: Yun Jae Jung, Suwon-si (KR); Taek You Kim, Incheon (KR)

(73) Assignees: HYUNDAI MOTOR COMPANY, Seoul (KR); KIA MOTORS CORPORATION, Seoul (KR); KYUNGSHIN CORP., Incheon (KR)

( * ) Notice: Subject to any disclaimer, the term of this patent is extended or adjusted under 35 U.S.C. 154(b) by 332 days.

(21) Appl. No.: 16/653,317

(22) Filed: Oct. 15, 2019

(65) Prior Publication Data

US 2020/0194938 A1 Jun. 18, 2020

(30) Foreign Application Priority Data

Dec. 12, 2018 (KR) ..... 10-2018-0159583

(51) Int. Cl.

| | |
|---|---|
| ***H01R 3/00*** | (2006.01) |
| ***H01R 13/6581*** | (2011.01) |
| ***H01R 13/502*** | (2006.01) |
| ***H01R 13/44*** | (2006.01) |
| ***H01R 13/52*** | (2006.01) |
| ***H01R 9/05*** | (2006.01) |

(52) U.S. Cl.

CPC ..... *H01R 13/6581* (2013.01); *H01R 9/0518* (2013.01); *H01R 13/44* (2013.01); *H01R 13/502* (2013.01); *H01R 13/5202* (2013.01); *H01R 13/5205* (2013.01)

(58) Field of Classification Search

CPC ..... H01R 13/5205; H01R 13/5219; H01R 13/5202; H01R 13/5208

USPC ..... 439/500, 566, 627

See application file for complete search history.

(56) References Cited

U.S. PATENT DOCUMENTS

| | | | | |
|---|---|---|---|---|
| 5,865,636 | A * | 2/1999 | Myer | H01R 13/5221 439/275 |
| 10,305,219 | B2 * | 5/2019 | Zebhauser | H01R 13/5025 |
| 10,320,110 | B2 * | 6/2019 | Loetkemann | H01R 13/516 |
| 11,424,577 | B2 * | 8/2022 | Kliever | H01R 13/64 |
| 2013/0323954 | A1 * | 12/2013 | Eckel | H01R 13/5205 439/271 |

* cited by examiner

*Primary Examiner* — Phuong Chi Thi Nguyen

(74) *Attorney, Agent, or Firm* — McDonnell Boehnen Hulbert & Berghoff LLP

(57) ABSTRACT

The present disclosure relates to an integrated multipole connector, and more particularly, an integrated multipole connector that can be used as a multipole connector integrating a plurality of connectors to which different current capacities and shielding structures are applied.

20 Claims, 24 Drawing Sheets

INTEGRATED MULTIPOLE CONNECTOR

CROSS-REFERENCE TO RELATED APPLICATION

This application claims priority under 35 U.S.C. § 119(a) to Korean Patent Application No. 10-2018-0159583 filed on Dec. 12, 2018, the entire contents of which are incorporated herein by reference.

BACKGROUND

(a) Technical Field

The present disclosure relates to an integrated multipole connector. More particularly, it relates to an integrated multipole connector that can be used as a multipole connector integrating a plurality of connectors to which different current capacities and shielding structures are applied.

(b) Background Art

In general, the specifications of connectors are classified according to the current capacity or shielding method applied thereto. Usually, one connector applies an equivalent level of current to one wire.

In a hybrid vehicle using an electric motor as a drive source, an electric power distributor is installed for distributing electric power not only to the electric motor but also to various electrical loads installed in the vehicle. The electric power distributor distributes electric power, which is supplied from a battery mounted on the vehicle, to the electric motor and each electrical load.

Since the electric motor consumes a very high current compared to the electrical load, different types of connectors are used such as a connector for applying a current to the electric motor and a connector for applying a current to the electrical load.

In addition, the conventional connector has different shielding structures according to the current capacity thereof. The current capacity of the connector may be classified into a small current and a large current based on the threshold current value thereof. For reasons such as reduction in cost and weight, a shielding structure is individually applied to each wire connected to each terminal in a small-current circuit connector, whereas a shielding structure is collectively applied to a plurality of terminals in a large-current circuit connector.

The size of the connector has increased as the current capacity of a vehicle has increased in recent years, and thus the area required for an in-vehicle electric power distributor to accommodate the connector is gradually increasing.

In order to resolve this problem, there has been developed a multipole connector integrating a plurality of small-current circuit connectors to which the same shielding structure is applied. However, it is difficult to integrate a small-current circuit connector, to which an individual shielding structure is applied, and a large-current circuit connector, to which a collective shielding structure is applied, because they have a problem relating to size increase and waterproofing due to integration.

It is possible to reduce the size when integrating connectors to which the same shielding structure is applied, but it is difficult to reduce the size when integrating connectors to which different shielding structures are applied. Therefore, there is a need for a new shielding structure. In addition, even when a new shielding structure is adopted to integrate connectors to which different shielding structures are applied, the connector may be corroded and damaged if the new shielding structure is not waterproof.

The above information disclosed in this Background section is only for enhancement of understanding of the background of the disclosure and therefore it may contain information that does not form the prior art that is already known in this country to a person of ordinary skill in the art.

SUMMARY

The present disclosure has been made in an effort to solve the above-described problems associated with prior art.

In an aspect, the present disclosure provides an integrated multipole connector that can be used as a multipole connector integrating a plurality of connectors to which different current capacities and shielding structures are applied.

In a preferred embodiment, there is provided an integrated multipole connector. The integrated multipole connector includes a female housing in which a first wire unit having a shield contact for electric field shielding and a second wire unit having a shield cover for electric field shielding are assembled, the second wire unit having a different current capacity from the first wire unit, a male housing coupled to the female housing, in which case a first male terminal electrically connected to the first wire unit and a second male terminal electrically connected to the second wire unit are assembled in the male housing, a male shield shell disposed into the male housing to shield electric fields of the first and second male terminals, and a female shield shell disposed into the female housing to shield an electric field between the female housing and the male housing by connection with the male shield shell when the female housing is coupled with the male housing.

The female shield shell may have a first contact part formed at its front end connected to a front end of the male shield shell, the first contact part being in contact with an inner surface of the front end of the male shield shell. The first contact part may come into elastic contact with the inner surface of the front end of the male shield shell when the front end of the female shield shell is inserted into the male shield shell. The female shield shell may have a second contact part formed at its rear end, the second contact part being connected to the shield contact by contact therewith. The second contact part may be formed in the female shield shell so as to come into elastic contact with the outside of the shield contact when the first wire unit passes through the female shield shell. The first wire unit may pass through the female shield shell when it is assembled to a first circuit insertion part of the female housing. The female shield shell may have a third contact part formed at its rear end, the third contact part being connected to the shield cover of the second wire unit by contact therewith. The third contact part may be formed in the female shield shell so as to come into elastic contact with the outside of the shield cover when the second wire unit passes through the female shield shell. The second wire unit may pass through the female shield shell when it is assembled to a second circuit insertion part of the female housing.

The first wire unit may include at least one small-current wire, a front end of which is disposed into the female shield shell, and the shield contact disposed around the center of the small-current wire. The small-current wire may include a core in which a current flows, and a wire screen for electric field shielding of the core. The first wire unit may include a core insulator disposed between the core and the wire screen to perform electrical insulation of the core, and a screen insulator disposed outside the wire screen to perform electrical insulation of the wire screen. The shield contact may be disposed around a front end of the wire screen, and the female shield shell and the wire screen may be disposed in front of and beyond the shield contact.

The second wire unit may include at least one large-current wire, a front end of which is disposed into the female shield shell, the shield cover into which a rear end of the large-current wire is inserted, and a shield screen fixed outside a rear end of the shield cover to surround the rear end of the large-current wire.

In the integrated multipole connector, when the male housing is installed to a shield housing for electric field shielding of an electric power distributor, a rear end of the male shield shell may be connected to the shield housing by contact therewith to enable electric field shielding between the shield housing and the male housing.

In the integrated multipole connector, a small-current wire seal may be disposed around the first wire unit to prevent introduction of moisture between the female housing and the first wire unit. In the integrated multipole connector, a cover seal may be disposed around the second wire unit to prevent introduction of moisture between the female housing and the second wire unit. In the integrated multipole connector, a large-current wire seal may be disposed around the large-current wire to prevent introduction of moisture between the large-current wire and the shield cover disposed outside the large-current wire. In the integrated multipole connector, a female connector seal may be installed into the female housing to prevent introduction of moisture between the female housing and the male housing. In the integrated multipole connector, a male connector seal may be disposed at a rear end of the male housing in contact with the shield housing to prevent introduction of moisture between the male housing and the shield housing.

In the integrated multipole connector, a female interlock terminal may be disposed in the female housing and a male interlock terminal may be disposed in the male housing. Thus, when electrical connection between the female interlock terminal and the male interlock terminal is completed, a current may be applied between the first wire unit and the first male terminal and between the second wire unit and the second male terminal, and the female shield shell and the male shield shell may be interconnected by contact therebetween.

Other aspects and preferred embodiments of the disclosure are discussed infra.

It is understood that the term "vehicle" or "vehicular" or other similar term as used herein is inclusive of motor vehicles in general such as passenger automobiles including sports utility vehicles (SUV), buses, trucks, various commercial vehicles, watercraft including a variety of boats and ships, aircraft, and the like, and includes hybrid vehicles, electric vehicles, plug-in hybrid electric vehicles, hydrogen-powered vehicles and other alternative fuel vehicles (e.g. fuels derived from resources other than petroleum). As referred to herein, a hybrid vehicle is a vehicle that has two or more sources of power, for example both gasoline-powered and electric-powered vehicles.

The above and other features of the disclosure are discussed infra.

BRIEF DESCRIPTION OF THE DRAWINGS

The above and other features of the present disclosure will now be described in detail with reference to certain exemplary embodiments thereof illustrated the accompanying drawings which are given hereinbelow by way of illustration only, and thus are not limitative of the present disclosure, and wherein.

Figure 1:
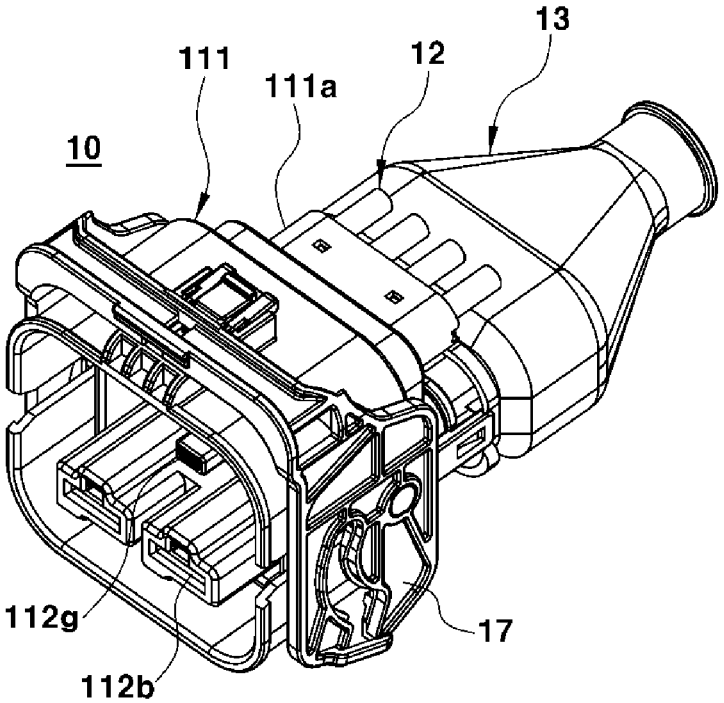
FIGS. 1 and 2 are views illustrating a female connector according to the present disclosure.

It should be understood that the appended drawings are not necessarily to scale, presenting a somewhat simplified representation of various preferred features illustrative of the basic principles of the disclosure. The specific design features of the present disclosure as disclosed herein, including, for example, specific dimensions, orientations, locations, and shapes will be determined in part by the particular intended application and use environment.

In the figures, reference numbers refer to the same or equivalent parts of the present disclosure throughout the several figures of the drawing.

DETAILED DESCRIPTION

Hereinafter reference will now be made in detail to various embodiments of the present disclosure, examples of which are illustrated in the accompanying drawings and described below. While the disclosure will be described in conjunction with exemplary embodiments, it will be understood that present description is not intended to limit the disclosure to those exemplary embodiments. On the contrary, the disclosure is intended to cover not only the exemplary embodiments, but also various alternatives, modifications, equivalents and other embodiments, which may be included within the spirit and scope of the disclosure as defined by the appended claims.

An integrated multipole connector 1 according to the present disclosure includes a female connector 10 and a male connector 20 inserted into the female connector 10 for connection thereto.

Figure 2:
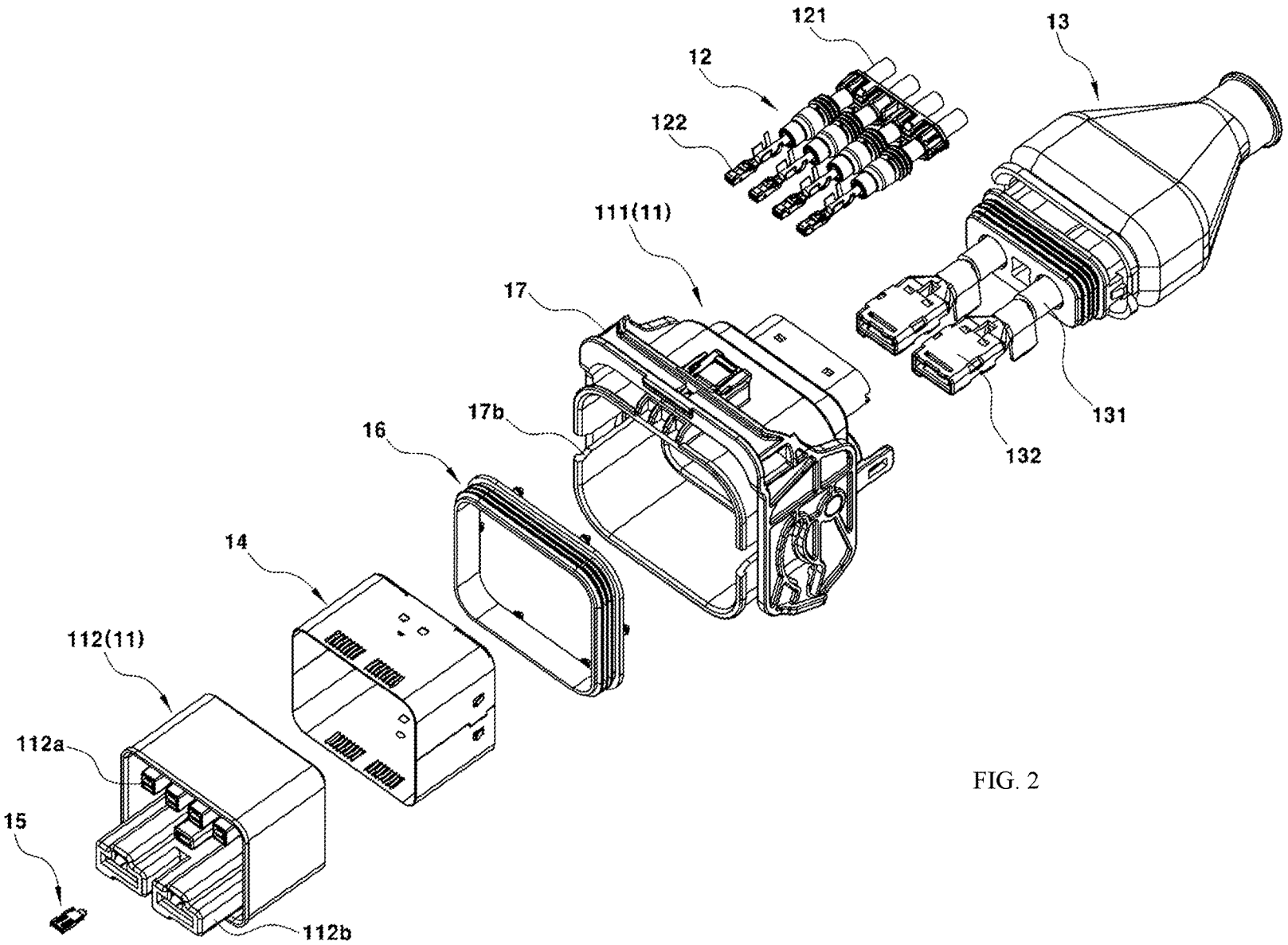

As illustrated in FIGS. 1 and 2, the female connector 10 may include a female housing 11 consisting of a female inner housing 112 and a female outer housing 111, and a female shield shell 14 disposed between the female inner housing 112 and the female outer housing 111.

The female inner housing 112 may be configured to protect terminals 122 and 132 of first and second wire units 12 and 13, and has a first female terminal protection part 112*a* for protecting the terminal 122 of the first wire unit 12 and a second female terminal protection part 112*b* for protecting the terminal 132 of the second wire unit 13.

Figure 24:
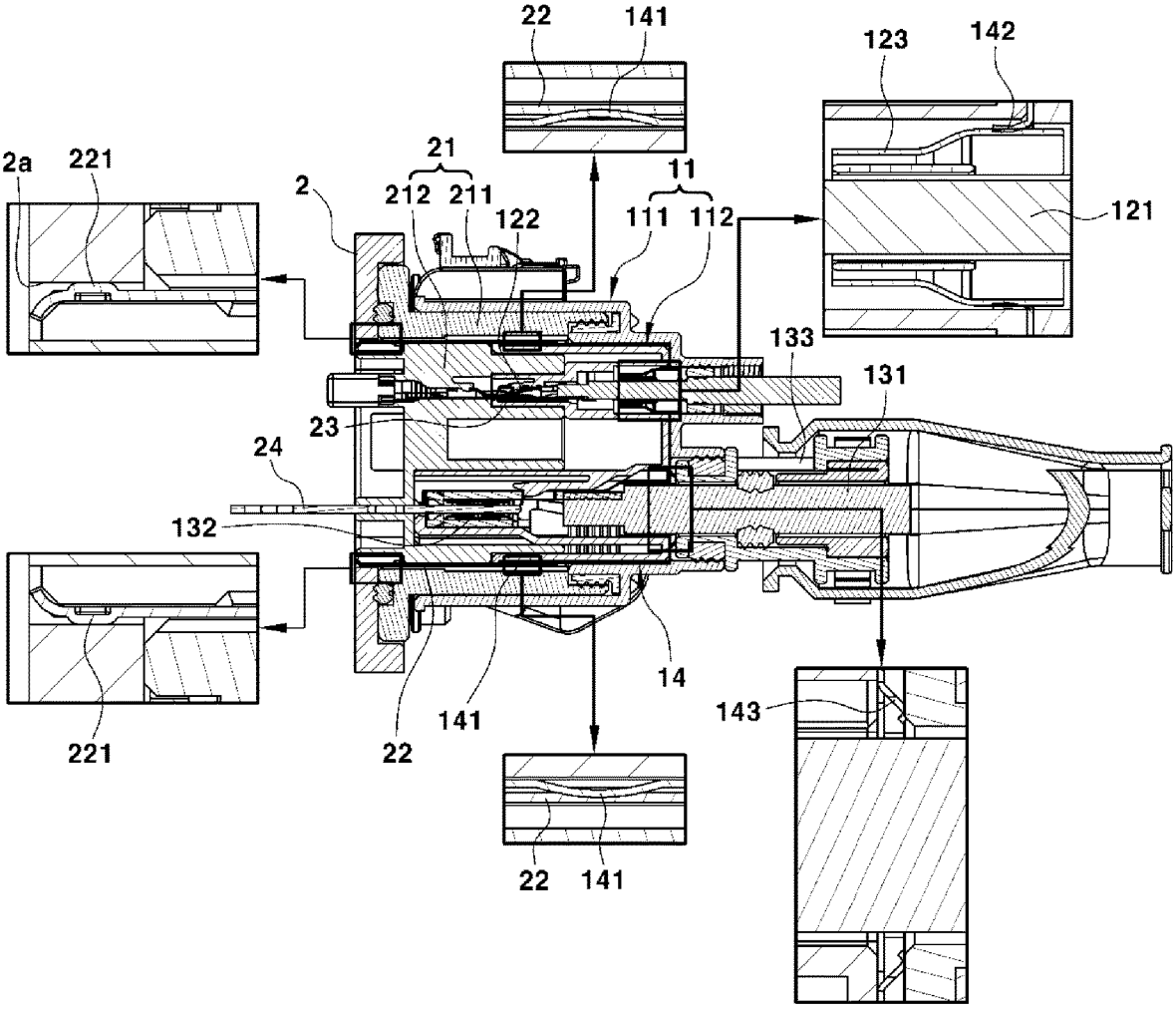
FIG. 24 is a view illustrating an integrated multipole connector coupled to the electric power distributor.

The female shield shell 14 may be configured to form a shielding structure between the female connector 10 and the male connector 20 by contact with the shield shell of the male connector 20 (i.e., a male shield shell 22) (see FIG. 24). The female shield shell 14 may be connected to the main shield shell 22 by contact therewith when the female connector 10 is coupled with the male connector 20. The female shield shell 14 is connected to the male shield shell 22, thereby enabling electric field shielding between the female housing 11 and a male housing 21.

Figure 20:
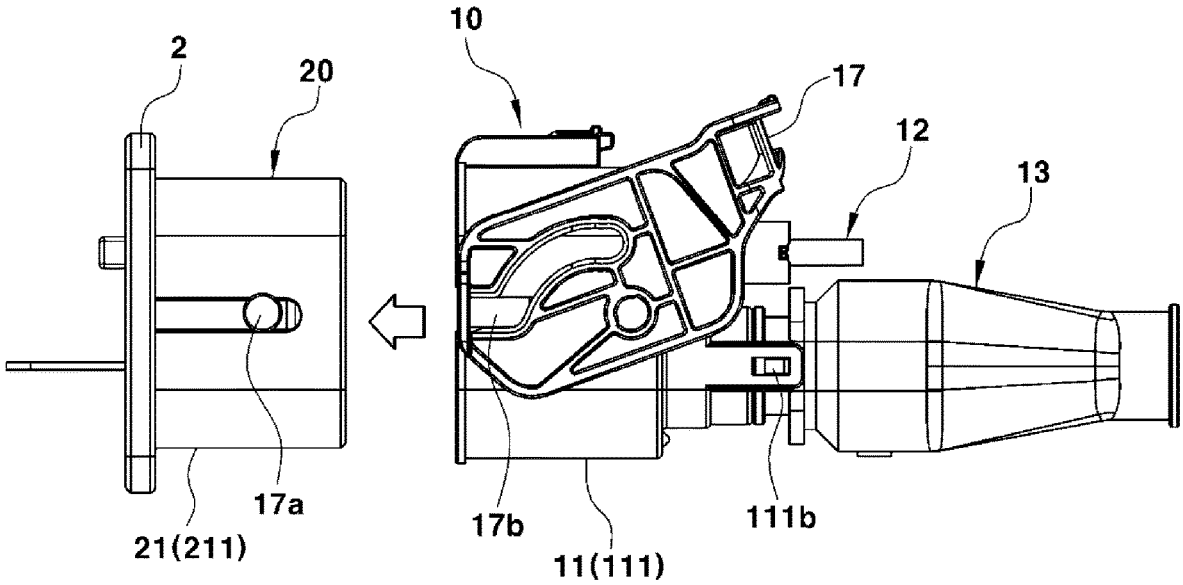
FIGS. 20, 21A, 21B, 22A, and 22B are views illustrating the operation of a lever member and a coupling process between the female connector and the male connector according to the present disclosure.

The female outer housing 111 may be provided with a lever member 17 capable of preventing an increase in the insertion force of the male connector 20 into a lever trajectory hole 17*b* for coupling between the female connector 10 and the male connector 20 (see FIG. 20). When the male connector 20 is inserted into the female connector 10, a lever trajectory protrusion 17*a* of the male connector 20 is movable along the lever trajectory hole 17*b*. The lever member 17 may be installed outside the female outer housing 111 so as to be rotatable at a predetermined angle. When the lever trajectory protrusion 17*a* of the male connector 20 is positioned in the lever trajectory hole 17*b*, the amount of insertion of the male connector 20 into the female housing 11 may be adjusted by the rotation of the lever member 17.

The female inner housing 112 is inserted into the female shield shell 14, and the female shield shell 14 is inserted into the female outer housing 111. In this case, as the shield member of the first wire unit 12 (i.e., a shield contact) assembled to the female housing 11 and the shield member of the second wire unit 13 (i.e., a shield cover) come into contact with the female shield shell 14, the shielding from the first wire unit 12 to the female housing 11 is enabled and the shielding from the second wire unit 13 to the female housing 11 is enabled (see FIG. 24).

Figure 25:
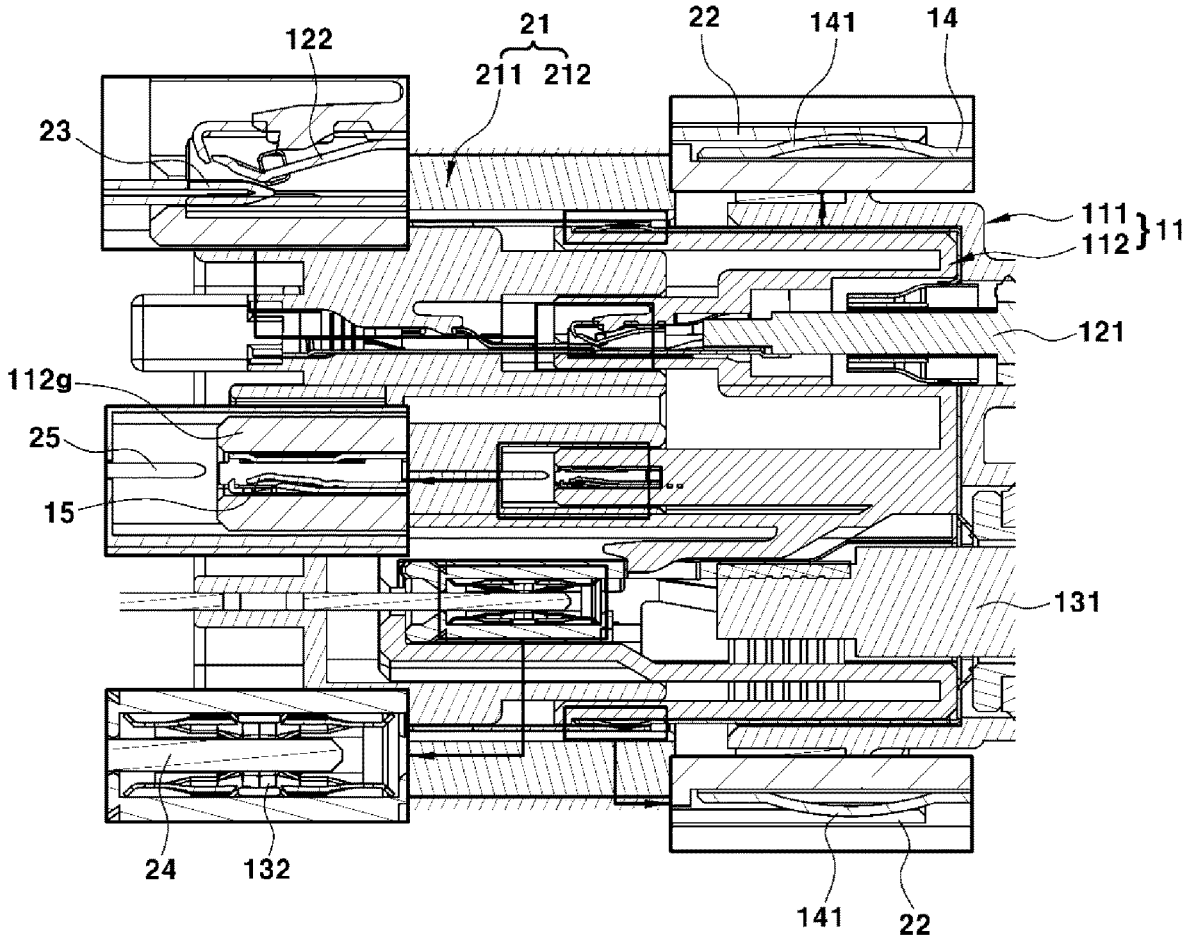
FIG. 25 is a view illustrating a state before an interlock terminal is connected.
Figure 26:
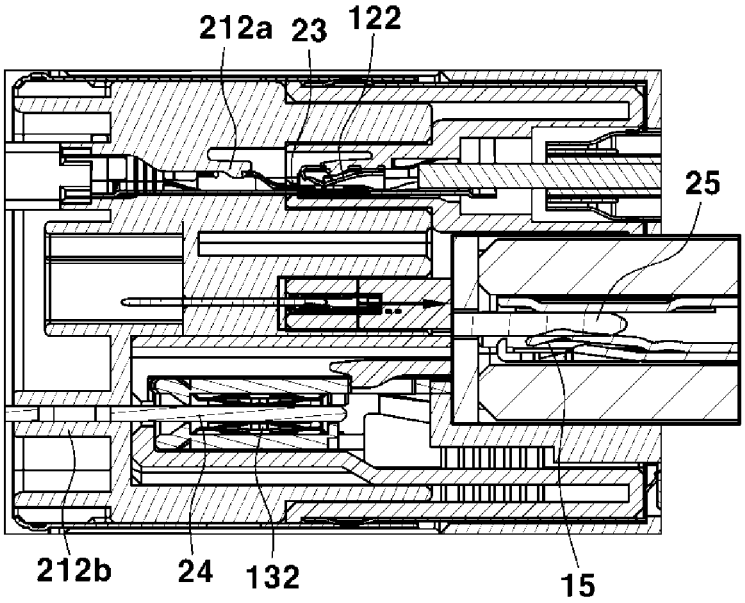
FIG. 26 is a view illustrating a state after the interlock terminal is connected.

Referring to FIGS. 25 and 26, after the contact and connection between the terminals of the female connector 10 (i.e., female terminals) and the terminals of the male connector 20 (i.e., male terminals) are completed when the female connector 10 is coupled with the male connector 20, and a female interlock terminal 15 is connected to a male interlock terminal 25 by contact therewith, thereby enabling a current to flow between the female terminals 122 and 132 and the male terminals 23 and 24. The female interlock terminal 15 may be assembled and fixed into the female inner housing 112. The female inner housing 112 may be provided with a female interlock terminal assembly part 112*g* into which the female interlock terminal 15 is inserted.

Figure 27:
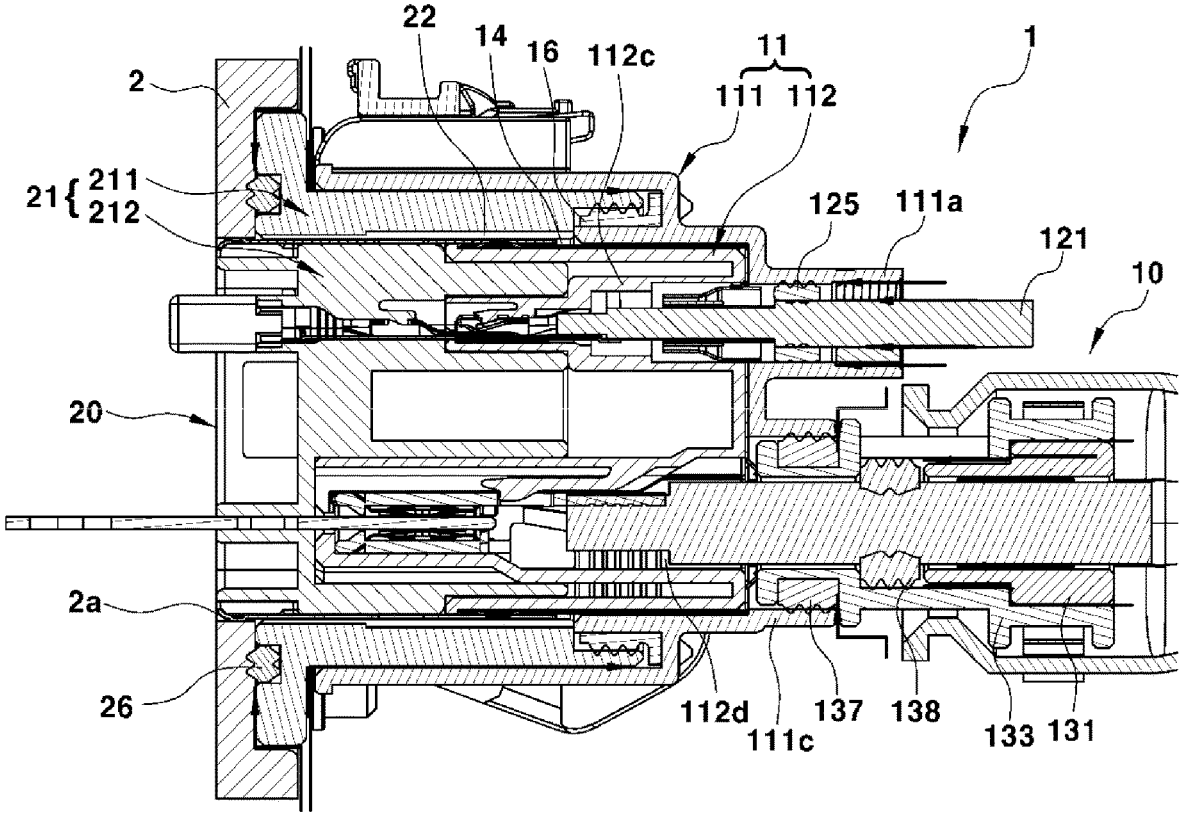
FIG. 27 is a view illustrating a structure for preventing water introduction that may occur in the integrated multipole connector according to the present disclosure.

A female connector seal 16, shown in FIG. 27, may be assembled into the female outer housing 111. It is possible to prevent introduction of moisture between the female connector 10 and the male connector 20 by the female connector seal 16 disposed between the female outer housing 111 and a male outer housing 211 when the female housing 11 is coupled with a male housing 21, namely when the female connector 10 is coupled with the male connector 20.

Figure 3:
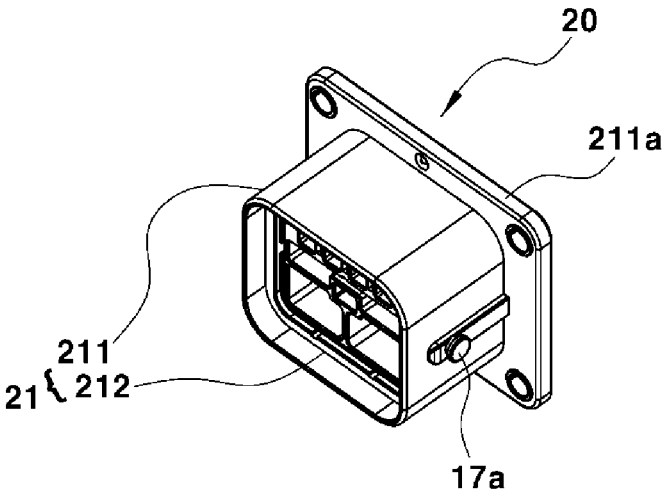
FIGS. 3 and 4 are views illustrating a male connector according to the present disclosure.
Figure 4:
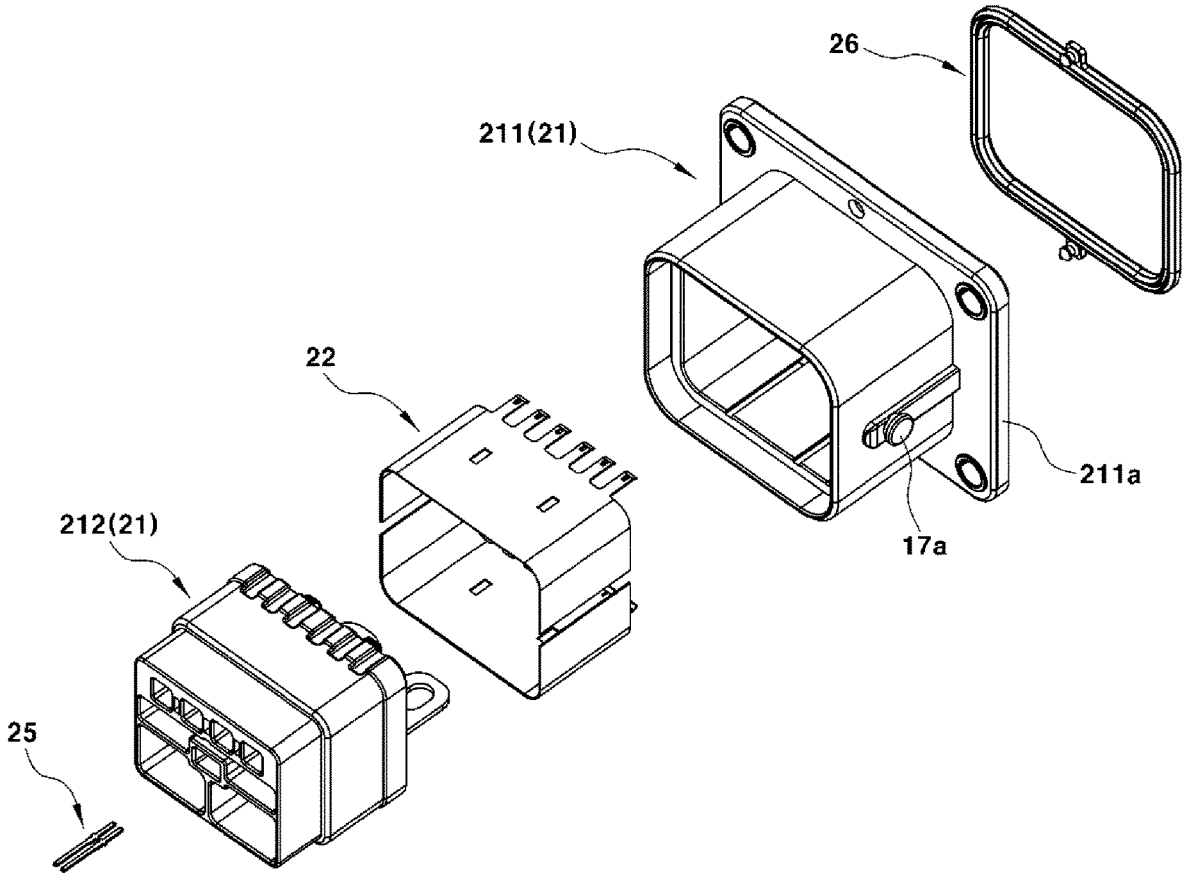

As illustrated in FIGS. 3 and 4, the male connector 20 may include a male housing 21 consisting of a male inner housing 212 and a male outer housing 211, and a male shield shell 22 disposed between the male inner housing 212 and the male outer housing 211.

The male inner housing 212 may be configured to protect terminals 122, 132, 15, 23, 24, and 25 included in the wire units 12 and 13. The terminals are a first male terminal 23 electrically connected to the first wire unit 12, a second male terminal 24 electrically connected to the second wire unit 13, and so on. The male inner housing 212 has a first male terminal protection part 212*a* for protecting the first male terminal 23 inserted thereinto and a second male terminal protection part 212*b* for protecting the second male terminal 24 inserted thereinto (see FIG. 26). The first and second male terminal protection parts 212*a* and 212*b* may be configured to support the first and second male terminals 23 and 24 without moving.

The male shield shell 22 may be configured to shield the electric fields of the first and second male terminals 23 and 24. The front end of the male shield shell 22 faces the front end of the female shield shell 14 and comes into contact therewith when the female connector 10 is coupled with the male connector 20. The rear end of the male shield shell 22 may realize electric field shielding between the male connector 20 and an electric power distributor by contact with a shield housing 2 of the electric power distributor. The front end of the male shield shell 22 is inserted into the female housing 22 when the female housing 11 is coupled with the male housing 21.

Figure 23:
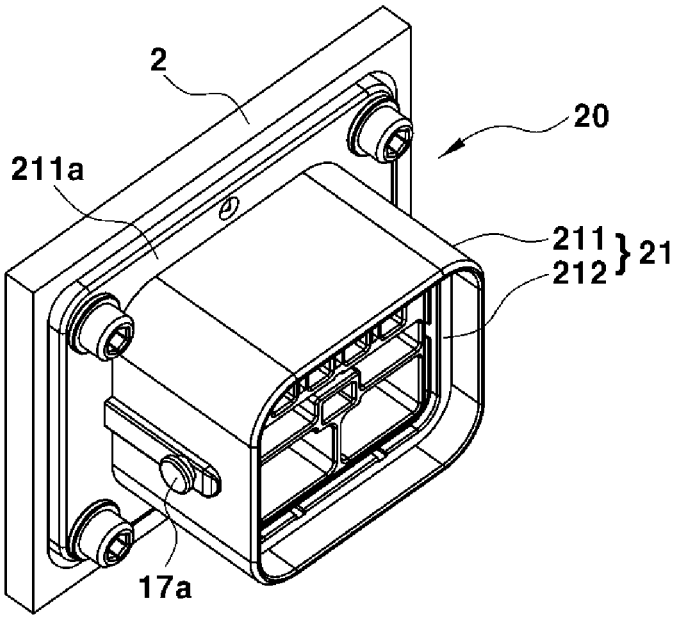
FIG. 23 is a view illustrating the male connector coupled to an electric power distributor.

As illustrated in FIG. 23, the male outer housing 211 may be fastened and fixed to the electric power distributor. The rear end of the male outer housing 211 may be provided with a mounting bracket 211*a* bolted to the shield housing 2 of the electric power distributor. The mounting point of the mounting bracket 211*a* may be provided with a bushing for vibration prevention.

As illustrated in FIGS. 25 and 26, after the contact and connection between the female terminals 122 and 132 and the male terminals 23 and 24 are completed when the female connector 10 is coupled with the male connector 20, the male interlock terminal 25 is connected to the female interlock terminal 15, thereby enabling a current to flow between the female terminals 122 and 132 and the male terminals 23 and 24. The male interlock terminal 25 may be assembled and fixed into the male inner housing 212. The male inner housing 212 may be configured to protect the male interlock terminal 25 inserted thereinto.

A male connector seal 26, shown in FIG. 27, is assembled so as to be disposed to the rear end of the male outer housing 211 (specifically, the rear end of the mounting bracket). It is possible to prevent introduction of moisture between the male housing 21 and the shield housing 2 of the electric power distributor by the male connector seal 26 disposed between the male outer housing 211 and the shield housing 2 when the female connector 10 is coupled with the male connector 20. Thus, the male connector seal 26 can prevent introduction of moisture between the male connector 20 and the shield housing 2 of the electric power distributor. When the male connector 20 is coupled to the shield housing 2, the rear end of the male outer housing 211 comes into the contact with the surface of the shield housing 2 and the rear end of the male inner housing 212 passes through the shield housing 2.

Figure 5:
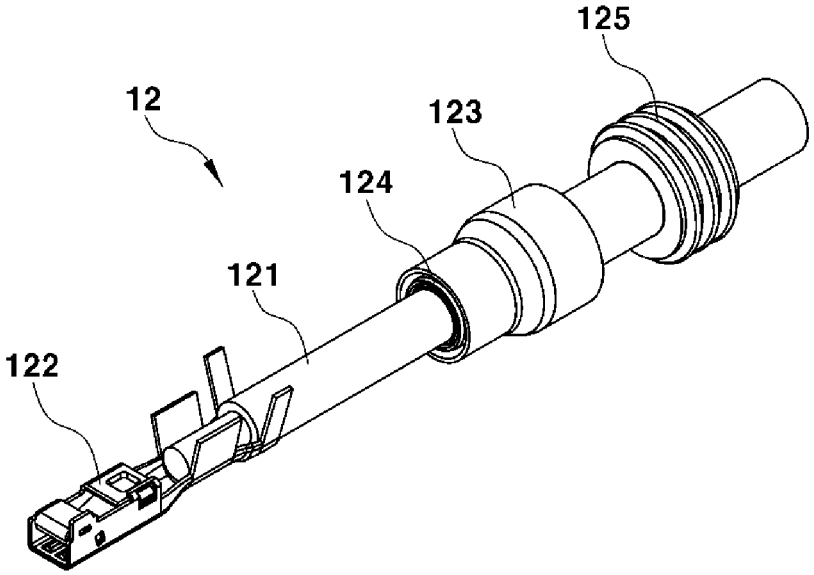
FIGS. 5, 6, and 7 are views illustrating a small-current wire according to the present disclosure.

As illustrated in FIGS. 2 and 5, the first wire unit 12 may include at least one small-current wire 121 (or referred to as "first wire") and a shield contact 123 disposed around the small-current wire 121. The shield contact 123 has an electric field shielding function, and may be disposed in the longitudinal center of the small-current wire 121. The small-current wire 121 may have a lower current capacity than a large-current wire 131 (or referred to as "second wire") by a predetermined value or more. The first wire unit 12 may include a plurality of small-current wires 121 having different current capacities.

Figure 6:
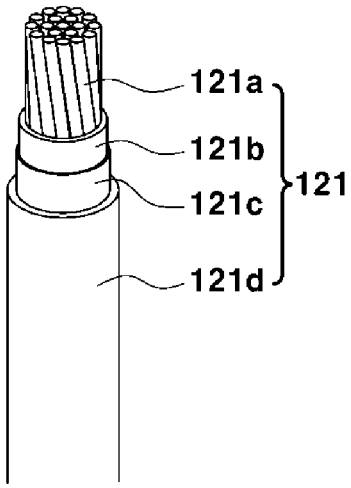
Figure 7:
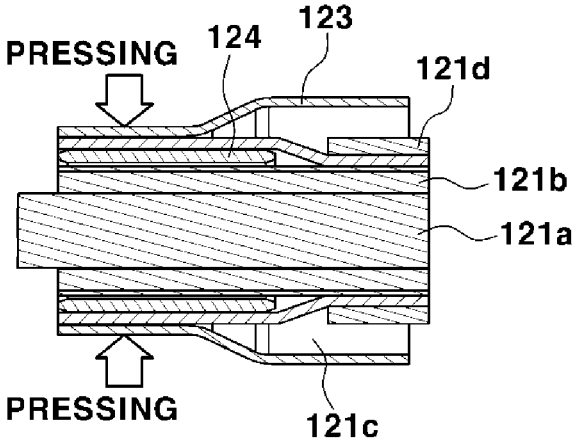

As illustrated in FIGS. 5 to 7, the small-current wire 121 may include a small-current core 121*a* forming a circuit for current application, a core insulator 121*b* surrounding the core 121*a*, a wire screen 121*c* disposed outside the core insulator 121*b*, and a screen insulator 121*d* disposed outside the wire screen 121*c*. A current may flow in the core 121*a*. The core insulator 121*b* surrounds the entire outer peripheral surface of the core 121*a* to block the current flowing in the core 121*a* from leaking to the outside of the core insulator 121*b*. The wire screen 121*c* performs electric field shielding so that the electric field generated by the current flowing in the core 121*a* does not affect the outside of the small-current wire 121. The screen insulator 121*d* performs the electrical insulation of the wire screen 121*c* to prevent an external current from flowing into the screen insulator 121*d*.

For circuit shielding in the small-current wire 121, after the small-current female terminal 122 (or referred to as "first female terminal") is pressed against and connected to the core 121*a*, a shield base 124 is assembled around the core insulator 121*b* and the wire screen 121*c* is disposed around the shield base 124. In this case, the wire screen 121*c* covers the shield base 124. The shield contact 123 is assembled outside the shield base 124 covered with the wire screen 121*c*. A portion where the shield contact 123, the wire screen 121*c*, and the shield base 124 are overlapped and stacked is pressed and fixed by equipment. In this case, the shield contact 123 is disposed around the front end of the wire screen 121*c*. When the small-current wire 121 is inserted into the female housing 11, the front end thereof (the portion having the first female terminal) is disposed into the female shield shell (see FIG. 24). Thus, the female shield shell 14 and the wire screen 121*c* are disposed in front of and behind the shield contact 123. The female shield shell 14 extends from the outside of the shield contact 123 to the male shield shell 22 and the wire screen 121*c* extends from the inside of the shield contact 123 to the opposite side of the male shield shell 22.

Figure 8:
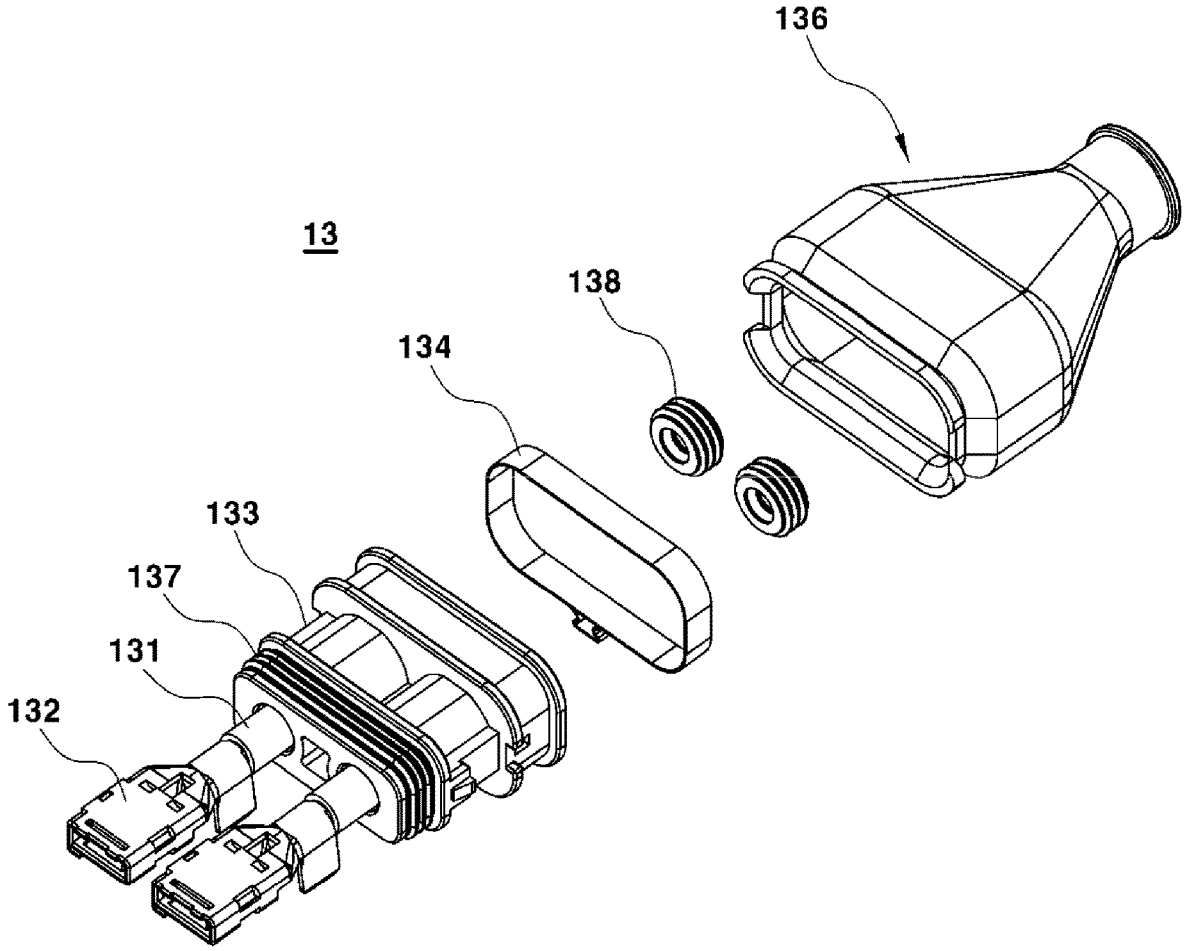
FIGS. 8, 9, and 10 are views illustrating a large-current wire according to the present disclosure.
Figure 9:
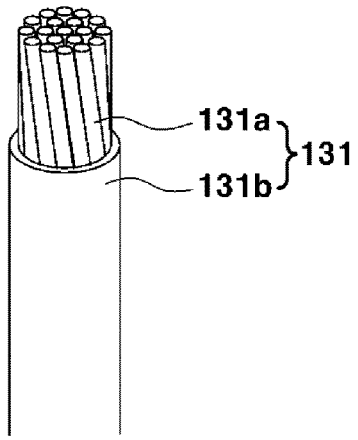
Figure 10:
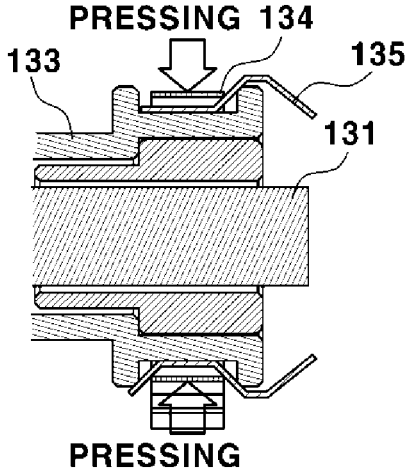

As illustrated in FIGS. 8 to 10, the second wire unit 13 may include at least one large-current wire 131, an aluminum shield cover 133 into which the rear end of the large-current wire 131 is inserted, and a shield screen 135 disposed outside the rear end of the shield cover 133. The front end of the large-current wire 131 may be disposed into the female shield shell 14. The shield screen 135 may surround the rear end of the large-current wire 131. The second wire unit 13 may include a plurality of large-current wires 131 having the same current capacity.

The large-current wire 131 may include a large-current core 131*a*, a core insulator 131*b* surrounding the core 131*a*, and a large-current female terminal 132. The large-current wire 131 is assembled in such a manner that after the large-current female terminal 132 (or referred to as "second female terminal") is pressed against and connected to the core 131*a*, the rear end of the large-current wire 131 passes through the inside of the shield cover 133. The rear end of the shield cover 133 and the rear end of the large-current wire 131 are surrounded by the shield screen 135 disposed around the rear end of the shield cover 133 into which the rear end of the large-current wire 131 (the portion which is not coupled with the large-current female terminal) is inserted. The shield screen 135 may shield the electric field generated in the wire. A crimping ring 134 is fitted around the shield cover 133 on the shield screen 135. The crimping ring 134 is pressed against the shield cover 133 by equipment. A protective grommet 136 is assembled on the crimping ring 134. The grommet 136 may cover the open rear end of the shield cover 133 to protect the rear end of the large-current wire 131. The shield cover 133 may be made of a metal material having an electric field shielding function such as aluminum.

In order to prevent introduction of moisture between the shield cover 133 and the large-current wire 131, a wire seal 138 is assembled around the large-current wire 131 (see FIG. 27). A cover seal 137 may be used for waterproofing between the shield cover 133 and the female connector 10. The cover seal 137 may be assembled to the front end of the shield cover 133. That is, the cover seal 137 may be assembled around the second wire unit 13. The cover seal 137 can prevent introduction of moisture between the female housing 11 and the second wire unit 13.

Figure 11:
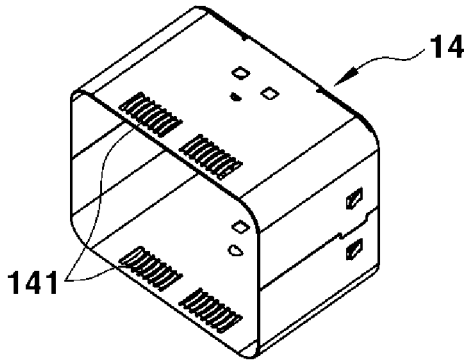
FIGS. 11 and 12 are views illustrating a female shield shell according to the present disclosure.
Figure 12:
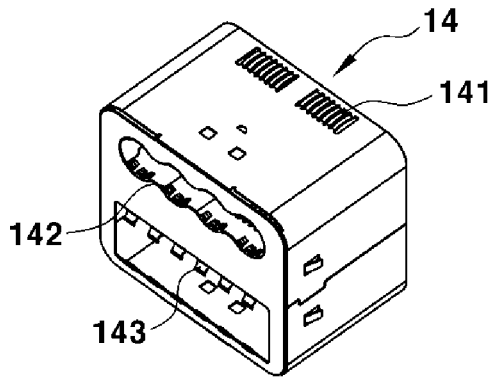

As illustrated in FIGS. 11 and 12, the female shield shell 14 includes first contact parts 141, a second contact part 142, and a third contact 143.

The first contact parts 141 may be formed at upper and lower ends of the front end of the female shield shell 14. The first contact parts 141 come into contact with the inner surface of the front end of the male shield shell 22 when the female connector 10 is coupled with the male connector 20 (see FIG. 24). The first contact parts 141 may come into elastic contact with the inner surface of the front end of the male shield shell 22 when the front end of the female shield shell 14 is inserted into the male shield shell 22.

Figure 14:
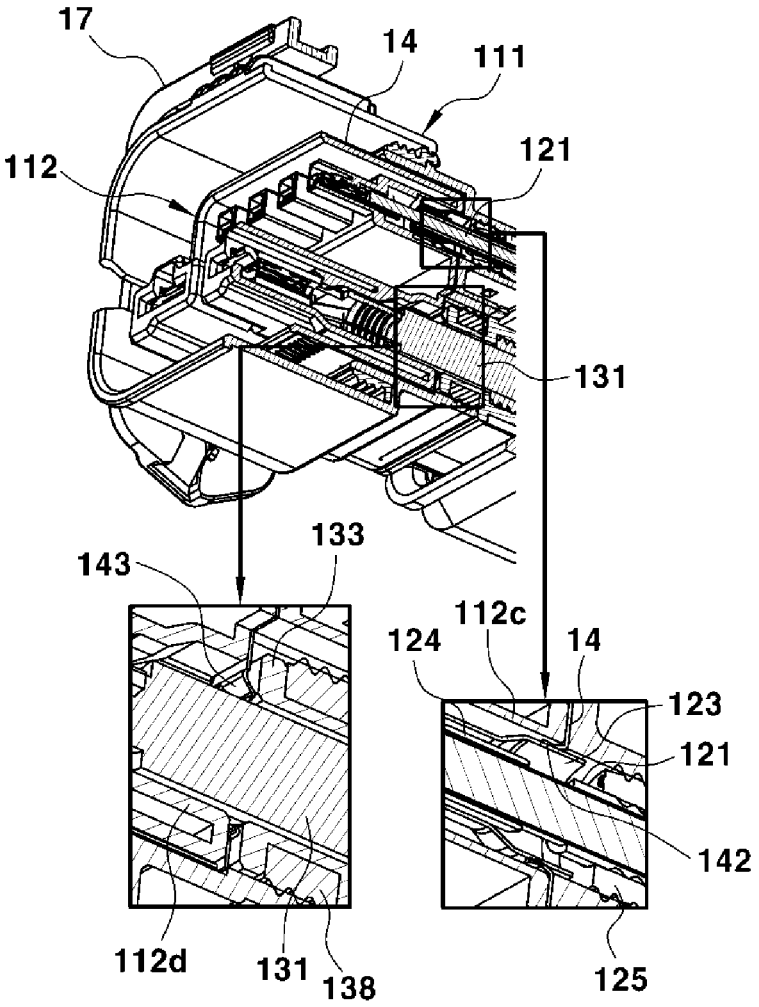
FIG. 14 is a cut view of the female connector according to the present disclosure.
Figure 15:
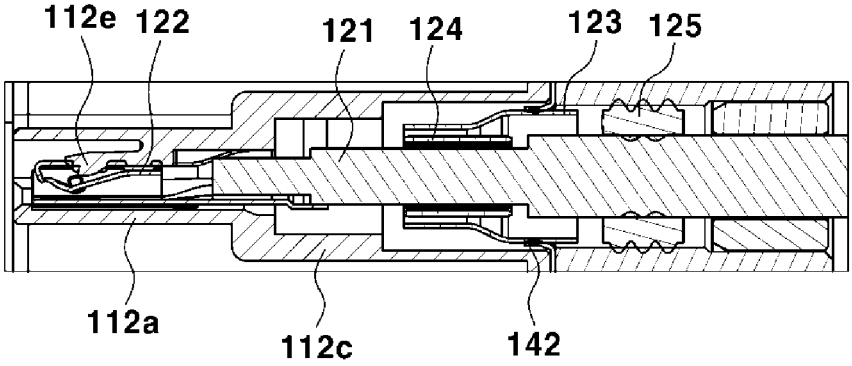
FIG. 15 is a view illustrating a state in which the first wire unit is assembled to the female housing according to the present disclosure.
Figure 16:
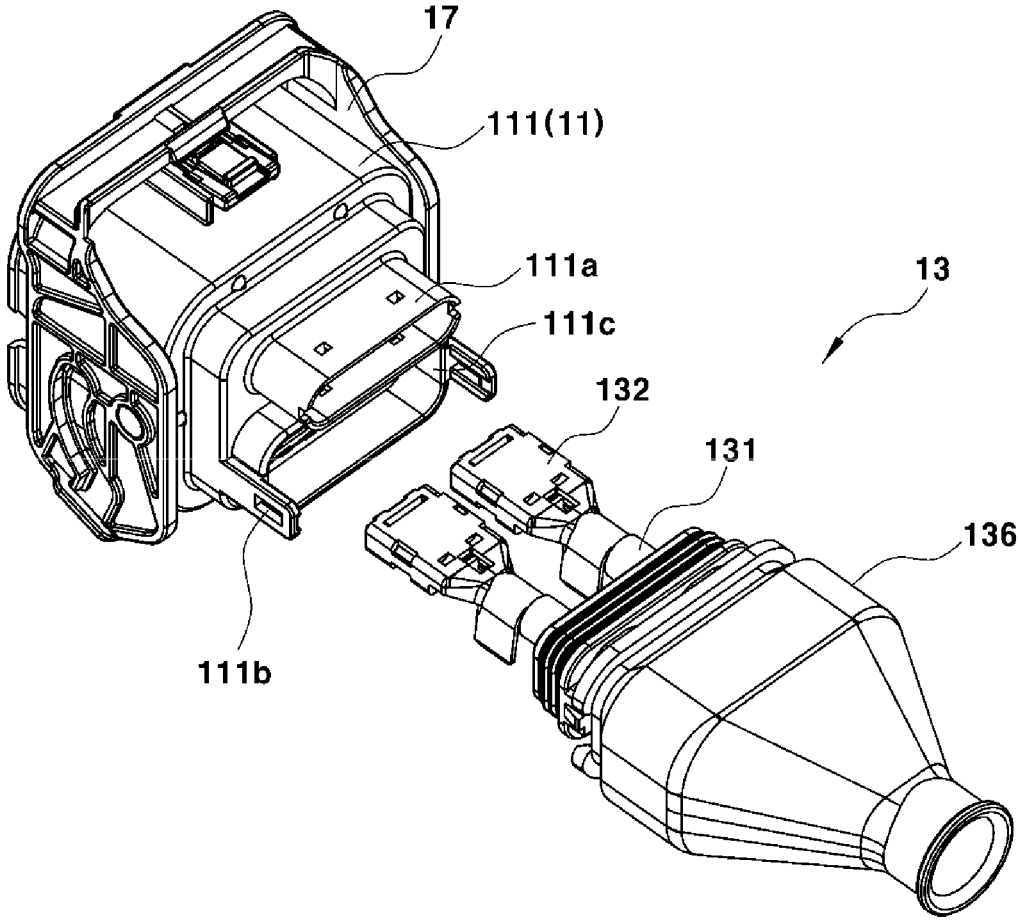
FIG. 16 is a view illustrating the female housing and a second wire unit according to the present disclosure.
Figure 17:
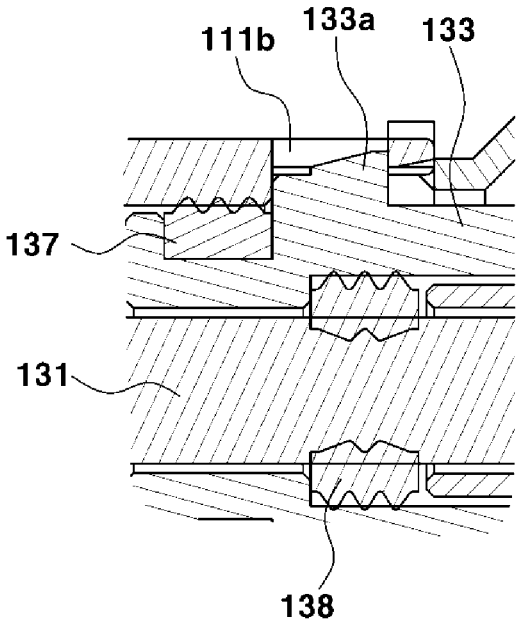
FIG. 17 is a view illustrating a coupling structure between the female housing and a shield cover according to the present disclosure.
Figure 18:
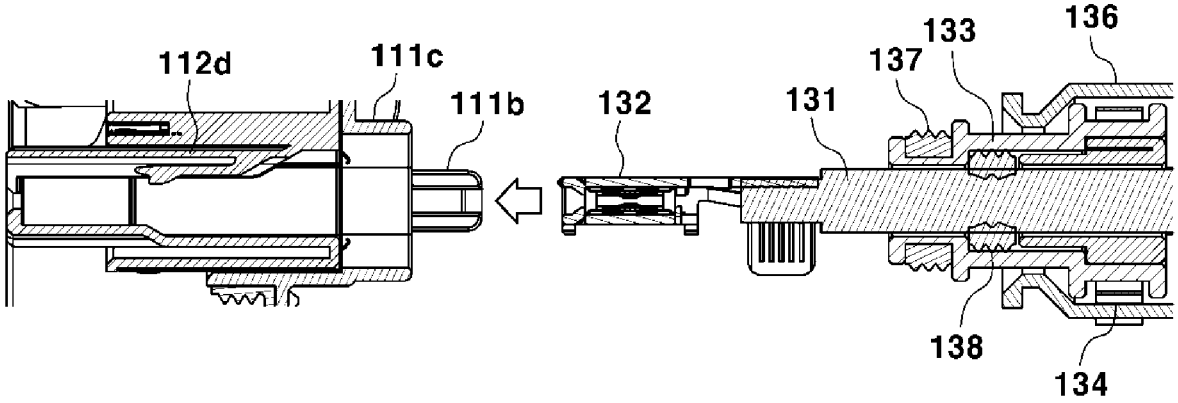
FIG. 18 is a view illustrating a state before the second wire unit is assembled to the female housing according to the present disclosure.
Figure 19:
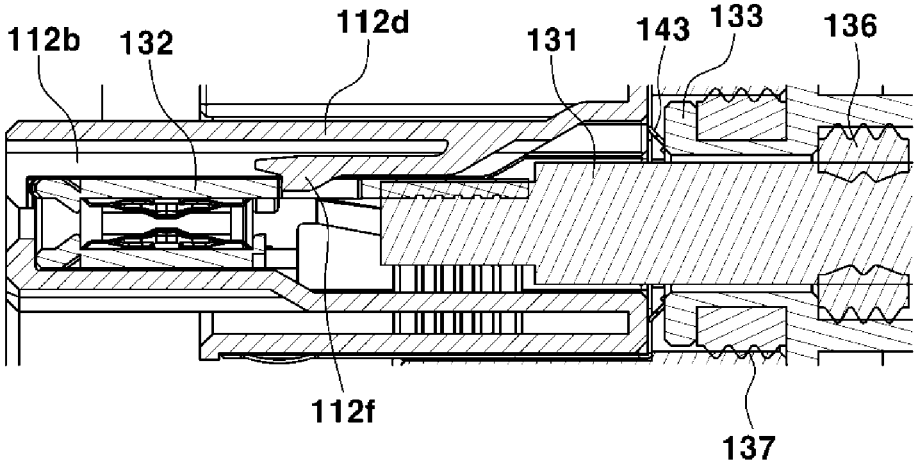
FIG. 19 is a view illustrating a state after the second wire unit is assembled to the female housing according to the present disclosure.

The second and third contact parts 142 and 143 may be formed at the rear end of the female shield shell 14. As illustrated in FIGS. 14 and 15, the second contact part 142 may form an electric field shielding structure connected to the shield contact 123 by contact with the shield contact 123 of the small-current wire 121 when the first wire unit 12 is inserted into a first circuit insertion part 112*c* of the female housing 11. The third contact part 143 may form an electric field shielding structure connected to the shield cover 133 by contact with the shield cover 133 of the second wire unit 13 when the second wire unit 13 is inserted into a second circuit insertion part 112*d* of the female housing 11.

The second contact part 142 may be formed at the rear end of the female shield shell 14 so as to come into elastic contact with the outside of the shield contact 123 when the first wire unit 12 presses through the female shield shell 14 disposed between the female outer housing 111 and the female inner housing 112. The third contact part 143 may be formed at the rear end of the female shield shell 14 so as to come into elastic contact with the outside of the shield cover 133 when the second wire unit 13 presses through the female shield shell 14. When the first wire unit 12 is inserted into the first circuit insertion part 112*c* of the female housing 11, it passes through the rear end of the female shield shell 14. When the second wire unit 13 is assembled to the second circuit insertion part 112*d* of the female housing 11, it passes through the rear end of the female shield shell 14.

Specifically, the second and third contact parts 142 and 143 may be elastically bent and deformed when the first and second wire units 12 and 13 pass through the rear end of the female shield shell 14, so that they may be in stable contact with the shield contact 123 and the shield cover 133 by the elastic restoring force generated at the time of the deformation.

The female shield shell 14 is connected to the male shield shell 22 by contact therewith when the electrical connection between the female interlock terminal 15 and the male interlock terminal 25 is completed.

Figure 13:
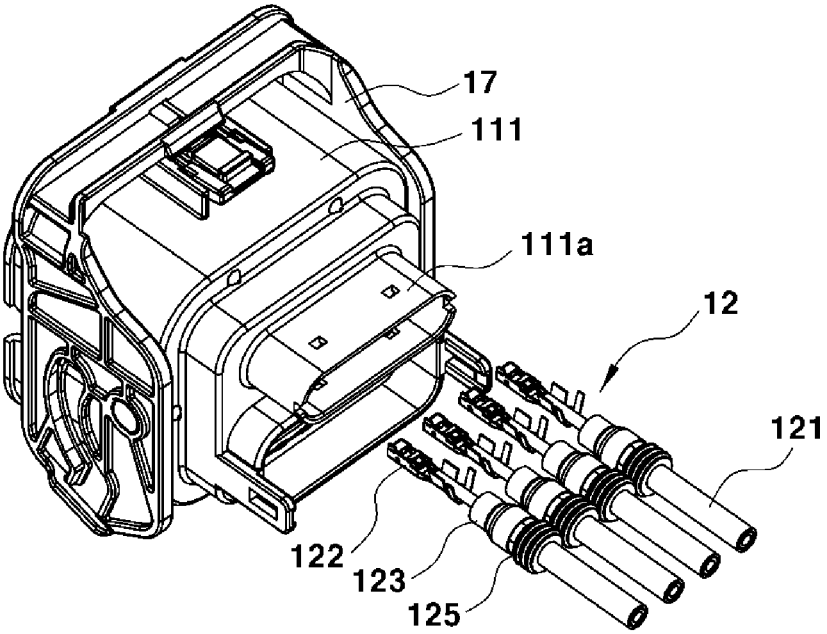
FIG. 13 is a view illustrating a female housing and a first wire unit according to the present disclosure.

As illustrated in FIGS. 13 to 15, when the first wire unit 12 is inserted into the first circuit insertion part 112*c* of the female inner housing 112 by passing through the rear end of the female outer housing 111 (the first circuit protection part), the first female terminal 122 is supported and fixed by a first terminal lance 112*e* of the female inner housing 112. In this case, the shield contact 123 of the first wire unit 12 is connected to the second contact part 142 in a contact manner by passing through the rear end of the female shield shell 14.

As illustrated in FIGS. 16 to 19, when the second wire unit 13 is inserted into the second circuit insertion part 112*d* of the female inner housing 112 by passing through the rear end of the female outer housing 111, the second female terminal 132 is supported and fixed by a second terminal lance 112*f* of the female inner housing 112. In this case, the shield cover 133 of the second wire unit 13 is connected to the third contact part 143 of the female shield shell 14 by contact therewith in the rear of the female shield shell 14. In addition, latching jaws 133*a* protruding from the shield cover 133 of the second wire unit 13 may be respectively latched to fixing parts 111*b* formed on both sides of the female outer housing 111.

As illustrated in FIGS. 20 to 22, when the female connector 10 is coupled with the male connector 20, the female connector 10 moves toward the male connector 20 fixed in the shield housing 2 of the electric power distributor and the male connector 20 is inserted into the female connector 10.

Figure 21A:
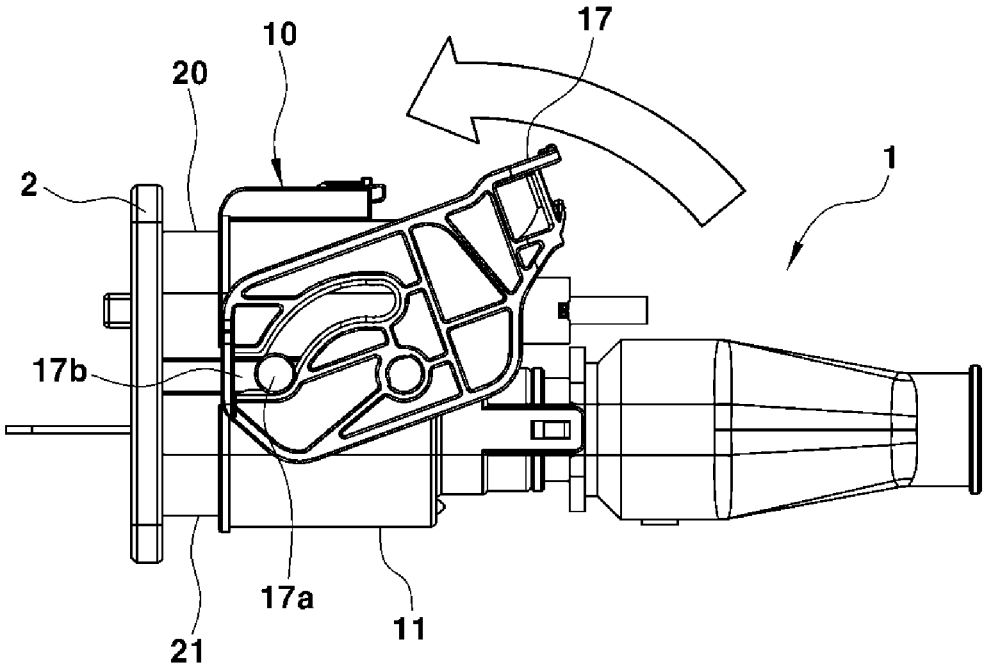
Figure 21B:
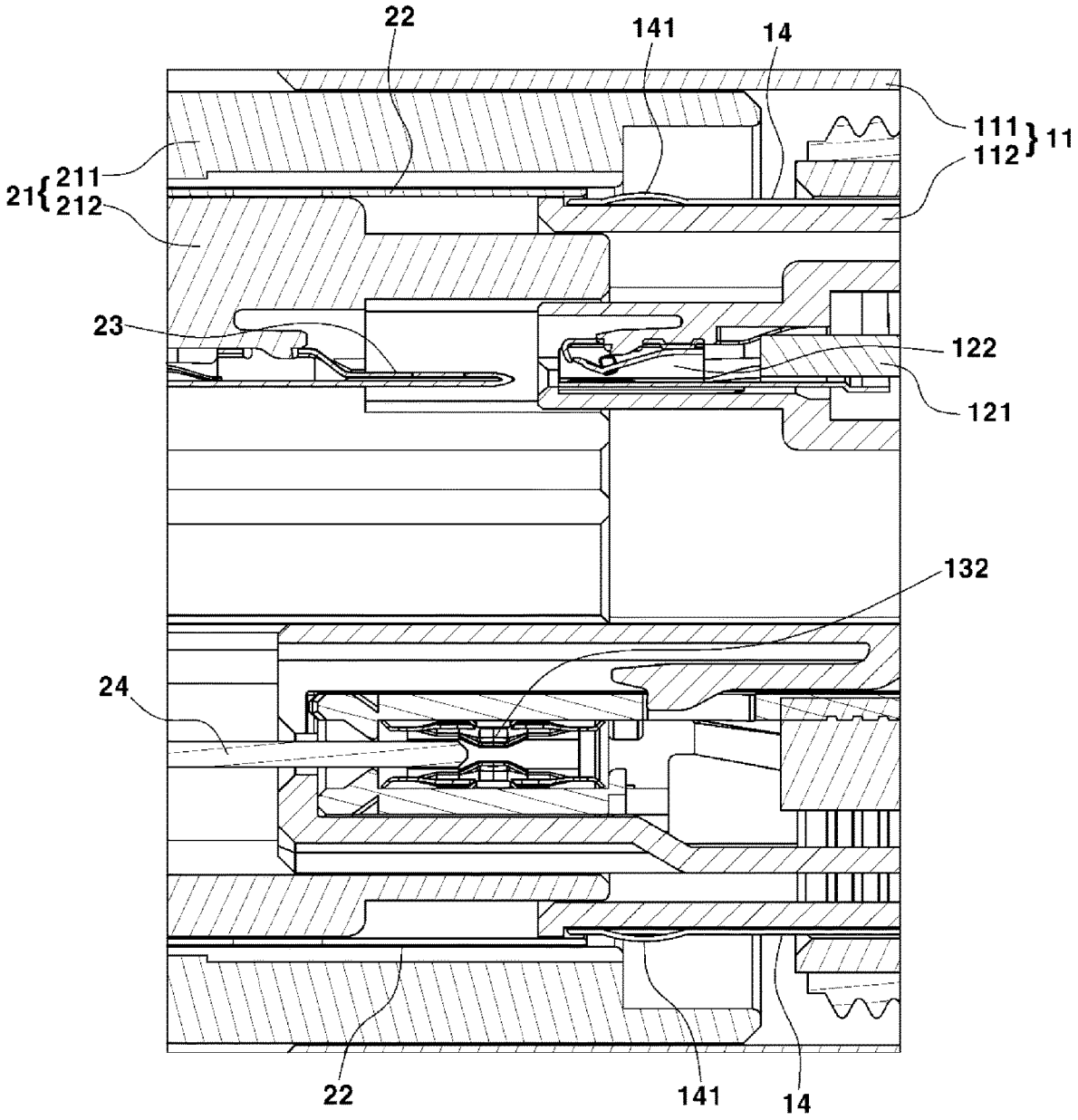

As illustrated in FIGS. 20 and 21A, when the male connector 20 is inserted into the female connector 10, the lever trajectory protrusion 17*a* protruding outward from the male outer housing 211 enters the lever trajectory hole 17*b* formed in the female outer housing 111. The male connector 20 is primarily inserted into the female connector 10 until the lever trajectory protrusion 17*a* is positioned in the middle of the lever trajectory hole 17*b*.

Figure 22A:
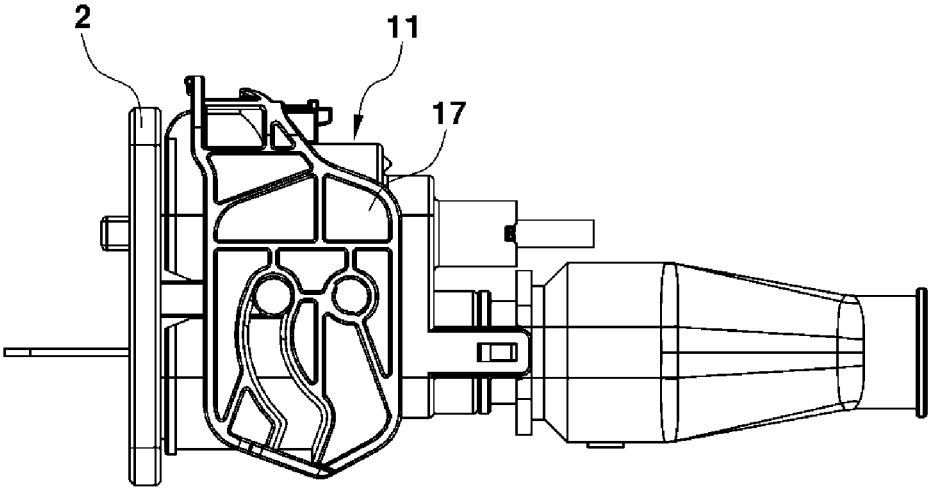

After the male connector 20 is primarily inserted into the female connector 10, the lever member 17 installed in the female outer housing 111 is rotated as illustrated in FIGS. 21A and 22A. As the lever member 17 rotates, the female connector 10 begins to move in a direction in which the female terminals 122 and 132 come into contact with the male terminals 23 and 24(see FIGS. 21B and 22B). The rotation of the lever member 17 allows the lever trajectory protrusion 17*a* to move to the distal end of the lever trajectory hole 17*b*, so that the male connector 20 is secondarily inserted into the female connector 10. The movement of the lever trajectory protrusion 17*a* in the lever trajectory hole 17*b* is restricted by the rotation of the lever member 17, and the amount of movement of the male connector 20 inserted into the female connector 10 is adjusted.

Figure 22B:
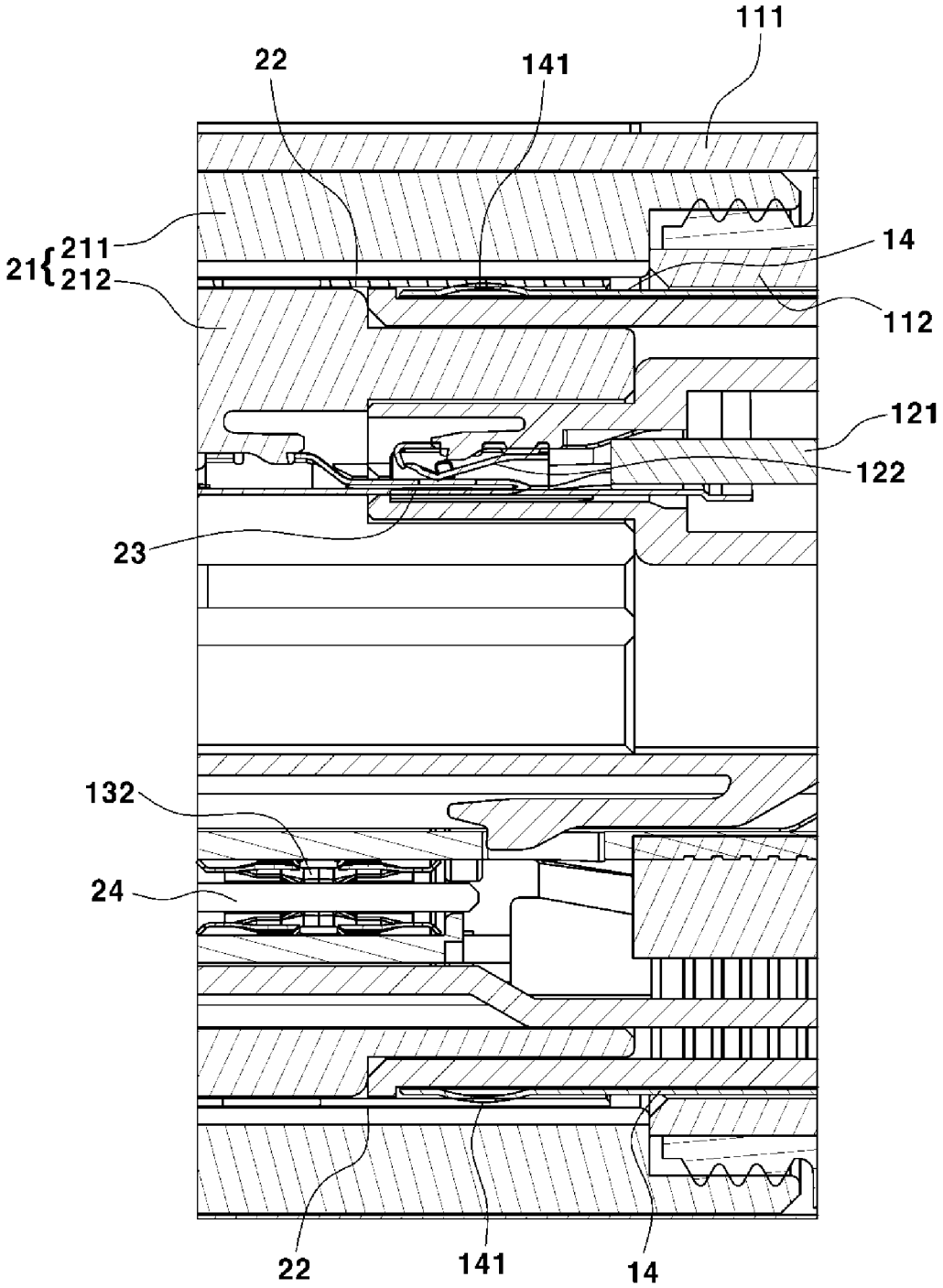

As illustrated in FIGS. 22A and 22B, the coupling between the female connector 10 and the male connector 20 is completed when the rotation of the lever member 17 is completed. That is, when the rotation of the lever member 17 is completed, the contact and connection between the female terminals 122 and 132 and the male terminals 23 and 24 are completed and the movement of the male connector 20 inserted into the female connector 10 is completed. In this case, the female terminals 122 and 132 and the male terminals 23 and 24 are in a state in which a current can flow. In addition, when the rotation of the lever member 17 is completed, the first contact parts 141 of the female shield shell 14 are in contact with the inner surface of the front end of the male shield shell 22. As the female shield shell 14 and the male shield shell 22 are interconnected in a contact manner, the shielding structure of the first and second wire units 12 and 13 extends from the female connector 10 to the male connector 20.

As illustrated in FIGS. 23 and 24, in the male connector 20, the mounting bracket 211*a* of the male outer housing 211 may be fastened and fixed to the electric power distributor. The electric power distributor includes the shield housing 2 for electric field shielding thereof, and the male outer housing 211 is fixedly mounted to the shield housing 2. The shield housing 2 may have a through-hole 2*a* formed in one side thereof so that the rear end of the male inner housing 212 is inserted into the through-hole 2*a*.

When the mounting bracket 211*a* of the male connector 20 is fastened to the shield housing 2, a shield contact part 221 of the male shield shell 22 comes into contact with the inner surface of the shield housing 2 (the surface surrounding the through-hole). Thus, electric field shielding is enabled between the shield housing 2 and the male shield shell 22. Since the shield housing 2 is entirely made of a metal material for shielding such as aluminum in the electric power distributor, electric field shielding is enabled in the internal space of the electric power distributor, i.e., in the internal space of the shield housing 2 in which components for electric power distribution are arranged. Accordingly, all regions where a current flows in the female connector 10, the male connector 20, and the electric power distributor become magnetic field shielding regions.

As illustrated in FIGS. 25 and 26, when the male connector 20 is coupled to the female connector 10, after the connection between the female terminals 122 and 132 and the male terminals 23 and 24 and the connection between the female shield shell 14 and the male shield shell 22 begin, the connection between the female terminals 122 and 132 and the male terminals 23 and 24 and the connection between the female shield shell 14 and the male shield shell 22 are completed when the insertion of the male connector 20 into the female connector 10 is completed. The male interlock terminal 25 and the female interlock terminal 15 prevent a current from flowing between the female terminals 122 and 132 and the male terminals 23 and 24 before the connection between the female terminals 122 and 132 and the male terminals 23 and 24 is completed. That is, the male interlock terminal 25 and the female interlock terminal 15 are not interconnected until the connection between the female terminals 122 and 132 and the male terminals 23 and 24 is completed. The connection between the male interlock terminal 25 and the female interlock terminal 15 enables a current to be applied between the female terminals 122 and 132 and the male terminals 23 and 24. That is, the connection between the male interlock terminal 25 and the female interlock terminal 15 enables a current to flow between the female terminals 122 and 132 and the male terminals 23 and 24. In addition, when the connection between the male interlock terminal 25 and the female interlock terminal 15 is completed, the male shield shell 22 and the female shield shell 14 are interconnected by contact therebetween.

In the state in which the coupling between the female connector 10, the male connector 20, and the electric power distributor is completed, moisture may be introduced in the direction indicated by the arrow in FIG. 27 between the female connector 10, the male connector 20, and the shield housing 2 of the electric power distributor. In order to prevent introduction of moisture between the female connector 10, the male connector 20, and the shield housing 2 of the electric power distributor, it is preferable that a seal member for waterproofing is installed for each position at which moisture introduction may occur. The seal member can prevent the shielding performance of the shielding-related components of the connector from deteriorating due to moisture by preventing the introduction of the moisture into the connector. In addition, the introduction of moisture from the outside is prevented in the rear end of the shield cover 133 that is difficult to be waterproofed by the seal member since the rear end of the shield cover 133 is covered with the grommet 136 (see FIGS. 18 and 19).

The seal member may include a small-current wire seal 125, a large-current wire seal 138, a cover seal 137, a female connector seal 16, a male connector seal 26, and the like. The small-current wire seal 125 may be configured to prevent introduction of moisture between the first circuit protection part 111*a* of the female outer housing 111 and the small-current wire 121. The first circuit protection part 111*a* is a portion which supports the rear end of the small-current wire 121 of the first wire unit 12 inserted thereinto. The small-current wire seal 125 may be installed around the first wire unit 12 (specifically, around the rear end of the small-current wire). The second circuit protection part 111*c* is a portion which supports the front end of the shield cover 133 of the second wire unit 13 inserted thereinto.

The integrated multipole connector 1 of the present disclosure having the above configuration further has the following advantages in addition to the above-mentioned effects.

It is possible to reduce the number of types of connectors accommodated in the electric power distributor by the structure that integrates the functions of the conventional small-current and large-current wire connectors. Therefore, it is possible to reduce the size of the electric power distributor.

It is possible to simplify the number of working processes of wiring harness by reducing the number of types of connectors accommodated in the electric power distributor. Since the number of types of connectors is reduced, it is possible to reduce the interlock circuits formed by the interlock terminals of the connector, to simplify the number of working processes for constituting the interlock circuits during the wiring of wiring harness, and to reduce parts such as the terminals and wires constituting the interlock circuits. Therefore, it is possible to reduce the manufacturing cost of the connector and increase productivity.

The integrated multipole connector according to the present disclosure has a structure that integrates a plurality of electric connectors having different current capacities and shielding structures. Therefore, it possible to reduce the number of types of connectors used for electrical connection of a plurality of wire units having different current capacities, and to reduce the size of the electric power distributor for distributing electric power to the wire units.

The disclosure has been described in detail with reference to preferred embodiments thereof. However, it will be appreciated by those skilled in the art that changes may be made in these embodiments without departing from the principles and spirit of the disclosure, the scope of which is defined in the appended claims and their equivalents.

The invention claimed is:

1. An integrated multipole connector comprising:

a female housing in which a first wire unit having a shield contact for electric field shielding and a second wire unit having a shield cover for electric field shielding are assembled, wherein the first wire unit has a first current capacity and the second wire has a second current capacity, wherein the second current capacity is higher than the first current capacity by a predetermined value;

a male housing coupled to the female housing, in which case a first male terminal electrically connected to the first wire unit and a second male terminal electrically connected to the second wire unit are assembled in the male housing;

a male shield shell disposed into the male housing to shield electric fields of the first and second male terminals; and a female shield shell disposed into the female housing to shield an electric field between the female housing and the male housing by connection with the male shield shell when the female housing is coupled with the male housing.

2. The integrated multipole connector of claim 1, wherein a small-current wire seal is disposed around the first wire unit to prevent introduction of moisture between the female housing and the first wire unit.

3. The integrated multipole connector of claim 1, wherein a cover seal is disposed around the second wire unit to prevent introduction of moisture between the female housing and the second wire unit.

4. The integrated multipole connector of claim 1, wherein a female connector seal is installed into the female housing to prevent introduction of moisture between the female housing and the male housing.

5. The integrated multipole connector of claim 1, wherein:

a female interlock terminal is disposed in the female housing and a male interlock terminal is disposed in the male housing; and when electrical connection between the female interlock terminal and the male interlock terminal is completed, a current is applied between the first wire unit and the first male terminal and between the second wire unit and the second male terminal, and the female shield shell and the male shield shell are interconnected by contact therebetween.

6. The integrated multipole connector of claim 1, wherein the second wire unit comprises:

at least one large-current wire, a front end of which is disposed into the female shield shell;

the shield cover into which a rear end of the large-current wire is inserted; and a shield screen fixed outside a rear end of the shield cover to surround the rear end of the large-current wire.

7. The integrated multipole connector of claim 6, wherein a large-current wire seal is disposed around the large-current wire to prevent introduction of moisture between the large-current wire and the shield cover disposed outside the large-current wire.

8. The integrated multipole connector of claim 1, wherein when the male housing is installed to a shield housing for electric field shielding of an electric power distributor, a rear end of the male shield shell is connected to the shield housing by contact therewith to enable electric field shielding between the shield housing and the male housing.

9. The integrated multipole connector of claim 8, wherein a male connector seal is disposed at a rear end of the male housing in contact with the shield housing to prevent introduction of moisture between the male housing and the shield housing.

10. The integrated multipole connector of claim 1, wherein the first wire unit comprises at least one small-current wire, a front end of which is disposed into the female shield shell, and the shield contact disposed around the center of the small-current wire, and the small-current wire comprises a core in which a current flows, and a wire screen for electric field shielding of the core.

11. The integrated multipole connector of claim 10, wherein the first wire unit comprises a core insulator disposed between the core and the wire screen to perform electrical insulation of the core, and a screen insulator disposed outside the wire screen to perform electrical insulation of the wire screen.

12. The integrated multipole connector of claim 10, wherein the shield contact is disposed around a front end of the wire screen, and the female shield shell and the wire screen are disposed in front of and beyond the shield contact.

13. The integrated multipole connector of claim 1, wherein the female shield shell has a first contact part formed at its front end connected to a front end of the male shield shell, the first contact part being in contact with an inner surface of the front end of the male shield shell.

14. The integrated multipole connector of claim 13, wherein the first contact part comes into elastic contact with the inner surface of the front end of the male shield shell when the front end of the female shield shell is inserted into the male shield shell.

15. The integrated multipole connector of claim 13, wherein the female shield shell has a second contact part formed at its rear end, the second contact part being connected to the shield contact by contact therewith.

16. The integrated multipole connector of claim 15, wherein the second contact part is formed in the female shield shell so as to come into elastic contact with the outside of the shield contact when the first wire unit passes through the female shield shell.

17. The integrated multipole connector of claim 16, wherein the first wire unit passes through the female shield shell when it is assembled to a first circuit insertion part of the female housing.

18. The integrated multipole connector of claim 13, wherein the female shield shell has a third contact part formed at its rear end, the third contact part being connected to the shield cover of the second wire unit by contact therewith.

19. The integrated multipole connector of claim 18, wherein the third contact part is formed in the female shield shell so as to come into elastic contact with the outside of the shield cover when the second wire unit passes through the female shield shell.

20. The integrated multipole connector of claim 19, wherein the second wire unit passes through the female shield shell when it is assembled to a second circuit insertion part of the female housing.

* * * * *